United States Patent [19]

Lind et al.

[11] Patent Number: 4,978,075

[45] Date of Patent: Dec. 18, 1990

[54] SOLVENT RESISTANT ELECTROSTATIC SPRAY GUN

[75] Inventors: Robert J. Lind, Robbinsdale; Stanley G. Karwoski, Oakdale, both of Minn.

[73] Assignee: Graco Inc., Minneapolis, Minn.

[21] Appl. No.: 446,879

[22] Filed: Dec. 6, 1989

Related U.S. Application Data

[62] Division of Ser. No. 366,608, Jun. 15, 1989, abandoned, and Ser. No. 225,159, Jul. 28, 1988, abandoned.

[51] Int. Cl.[5] ..... B05B 5/02

[52] U.S. Cl. ..... 239/690; 361/228; 361/235

[58] Field of Search ..... 239/690, 691, 700–703; 361/227, 228, 235

[56] References Cited

U.S. PATENT DOCUMENTS

| | | | |
|---|---|---|---|
| 4,033,506 | 7/1977 | Braun | 361/228 |
| 4,120,016 | 10/1978 | Hendricks | 361/235 |
| 4,290,091 | 9/1981 | Malcolm | 239/690 |
| 4,682,735 | 7/1987 | Mommsen | 239/691 |

FOREIGN PATENT DOCUMENTS

| | | | |
|---|---|---|---|
| 2153260 | 8/1985 | United Kingdom | 239/690 |
| 2172219 | 9/1986 | United Kingdom | 239/690 |

*Primary Examiner*—Andres Kashnikow
*Assistant Examiner*—Karen B. Merritt

[57] ABSTRACT

An electrostatic spray gun having an internal alternator-turbine power supply is provided with an air circuit which divides the air passages to the front end of the gun on one hand and to the power supply in the other hand at the trigger valve to prevent paint or solvent leakage into the power supply. The power supply is completely encapsulated or potted such that the only parts of the power supply extending through the containment are heat sinks, electrical connectors and a voltage indicator. Lastly, as C-clip is provided to attach the turbine alternator to the rest of the power supply which utilizes an interior groove on the alternator turbine and an exterior groove on the main body of the power supply.

3 Claims, 2 Drawing Sheets

SOLVENT RESISTANT ELECTROSTATIC SPRAY GUN

This is a division, of application Ser. No. 366,608, filed Jun. 15, 1989, now abandoned, and of application Ser. No. 225,159 filed Jul. 28, 1988, now abandoned.

BACKGROUND OF THE INVENTION

Electrostatic Spray Guns having self-contained power supplies are well known in the prior art as typified by U.S. Pat. Nos. 4,219,865, 4,290,091 and 4,377,838. Such guns tend to have more problems resulting from solvent and/or paint infiltrating the power supply than conventional guns duc to the connection of the air passages between the two areas of the gun.

It is therefore an object of this invention to provide a solvent resistant electrostatic spray gun which is relatively impervious to infiltration of solvent and/or paint. It is a further object of this invention to provide such a gun which is easily and expeditiously assembled and manufactured and which may be easily repaired. It is yet further an object of this invention to provide such a gun as will operate reliably under the most severe of conditions.

SUMMARY OF THE INVENTION

A construction is provided which yields a particularly reliable and manufacturable electrostatic spray gun. The power supply is in general shown and described in the prior U.S. Patents referenced above, the contents of which are herein incorporated by reference. The contents of the power supply, including the multiplier and the other conditioning electronics are entirely encapsulated within a molded member which contains a potting material. Only a limited number of components are allowed to extend through and outside the potting material, those components including a ground connection, an electrostatic connection for connection to the electrode at the front of the gun, heat sink fins and a connector for connection to the alternator-turbine set. By otherwise completely encapsulating the power supply, it is rendered substantially resistant to paints, solvents and other materials which could affect the reliability of the power supply.

To further prevent the power supply from being harmed by paints and solvents, separate air circuits are provided from the trigger valve to the turbine and power supply on one hand and to the air cap and pattern control circuit on the other hand. Typically in such guns, paint and solvent work their way backwardly through the air cap passages and into the turbine supply passages. By separating those passages at the trigger valve and by optionally providing a positive air pressure into the turbine and power supply air supply whether the gun is activated or not, intrusion of paint or solvent into the turbine air supply is substantially eliminated.

The alternator-turbine is attached to the power supply cartridge by means of a novel attachment device which is particularly suited for use in this environment. The power supply has a plug extending therefrom having a groove about the periphery thereof. A C-clip ring is located in the aforementioned groove and interacts with a similar groove located on the interior of a socket located in the end of the alternator turbine unit. A sloping ramp is provided at the edge of the alternator turbine unit which automatically compresses the C-shaped snap ring for installation. A cut-out in one side of the socket accommodates the end ears of the C-ring.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
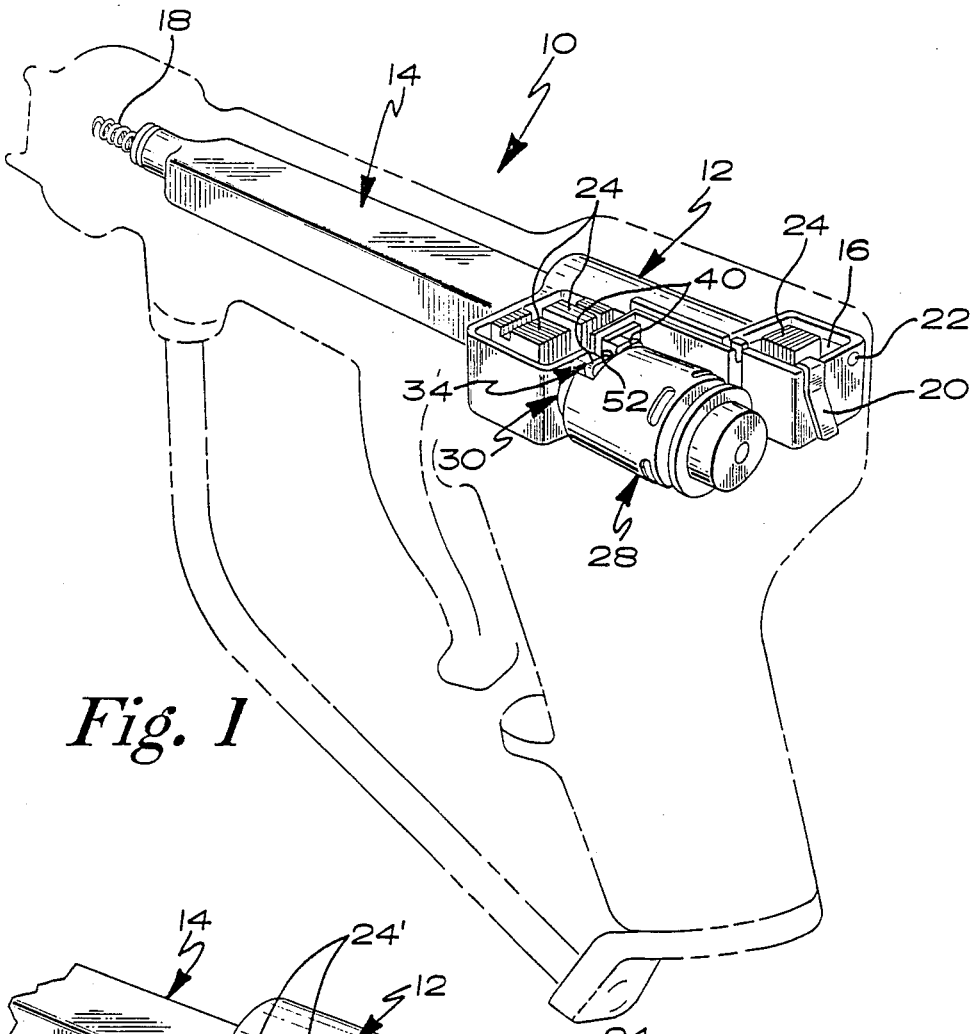
FIG. 1 is a perspective view showing the power supply located inside an electrostatic spray gun which is shown in phantom.

An electrostatic spray gun, generally designated 10 is provided therein with an electrostatic power supply cartridge assembly 12. Power supply cartridge 12 is comprised of a molded member 14 having circuitry (not shown in detail but heretofore incorporated by reference) therein which is encapsulated in the molded member 14 by a potting material 16. A very limited number of elements extend through the molded member 14 and encapsulation 16. These elements include the electrode contact 18 at the front end of gun 10, a ground contact 20 adjacent the rear thereof, a voltage indicator LED 22 adjacent the rear end, heat sink fins 24 and alternator connection pins 26 (shown in FIG. 2). By totally encapsulating the delicate elements of the multiplier and power supply circuitry in the potting material 16, the cartridge 12 is rendered substantially impervious to paint, solvents and other materials.

Figure 2:
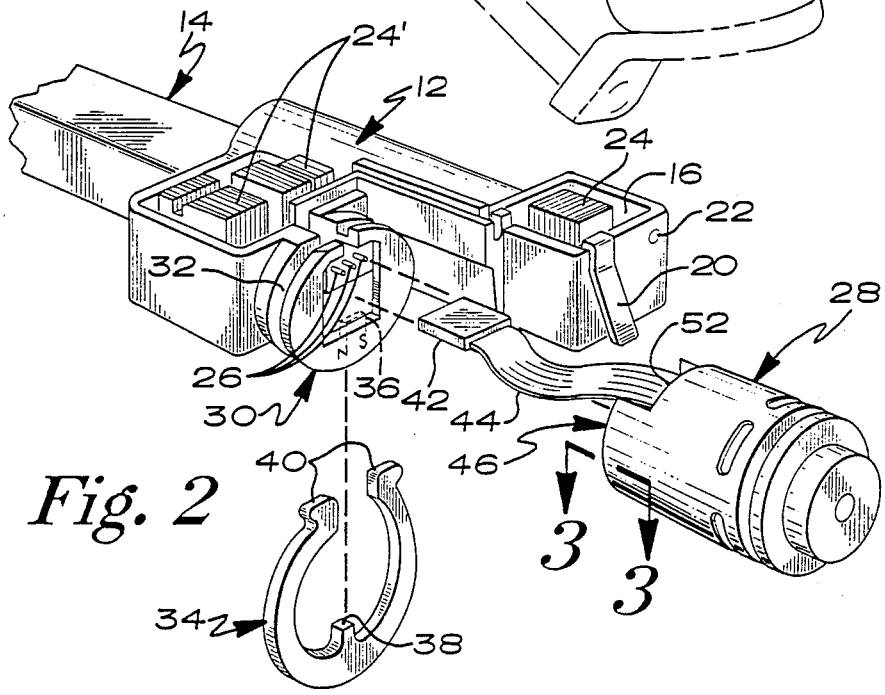
FIG. 2 is an exploded view of the power supply alternator-turbine unit and attachment mechanism.
Figure 3:
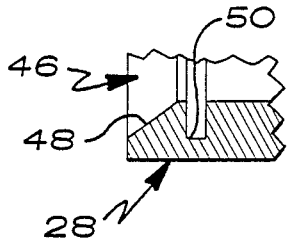
FIG. 3 is a sectional view taken along line 3—3 of FIG. 2.

FIGS. 2 and 3 show in more detail the attachment mechanism for alternator-turbine power supply 12. A plug member 30 extends rearwardly from power supply 12 and has located about the periphery thereof a groove 32 for retention of C-shaped snap ring 34. Groove 32 has a depression 36 therein for receiving a projection 38 on C-ring 34. C-ring 34 is provided with end ears 40 which may be used to flex C-ring 34 for assembly and disassembly. C-ring 34 may be formed of a plastic or other reasonably flexible material.

Connector pins 26 are intended for attachment to electrical socket 42 which is connected via ribbon cable 44 to alternator turbine 28. As can be seen in FIG. 3, the socket 46 and the end of alternator turbine 28 is provided with a sloping ramp 48 which leads to a groove 50 for receiving C-ring 34. A cut-out 52 extends around a portion of the periphery of socket 46 and accomodates end ears 40 of C-ring 34. Assembly may be easily accomplished by first placing C-ring 34 on plug 30 so that projection 38 seats in depression 36. Electrical socket 42 is attached to pins 26 and then alternator-turbine 28 is merely pressed onto the combination of plug 30 and C-ring 34. Note that because of ramp 48, it is not necessary to squeeze end ears 40 but rather the ramp forces compression of C-ring 34 until it snaps into place with end ears 40 located in cut-away 52. In order to remove alternator turbine 28, one need merely slightly squeeze end ears 40.

Figure 4:
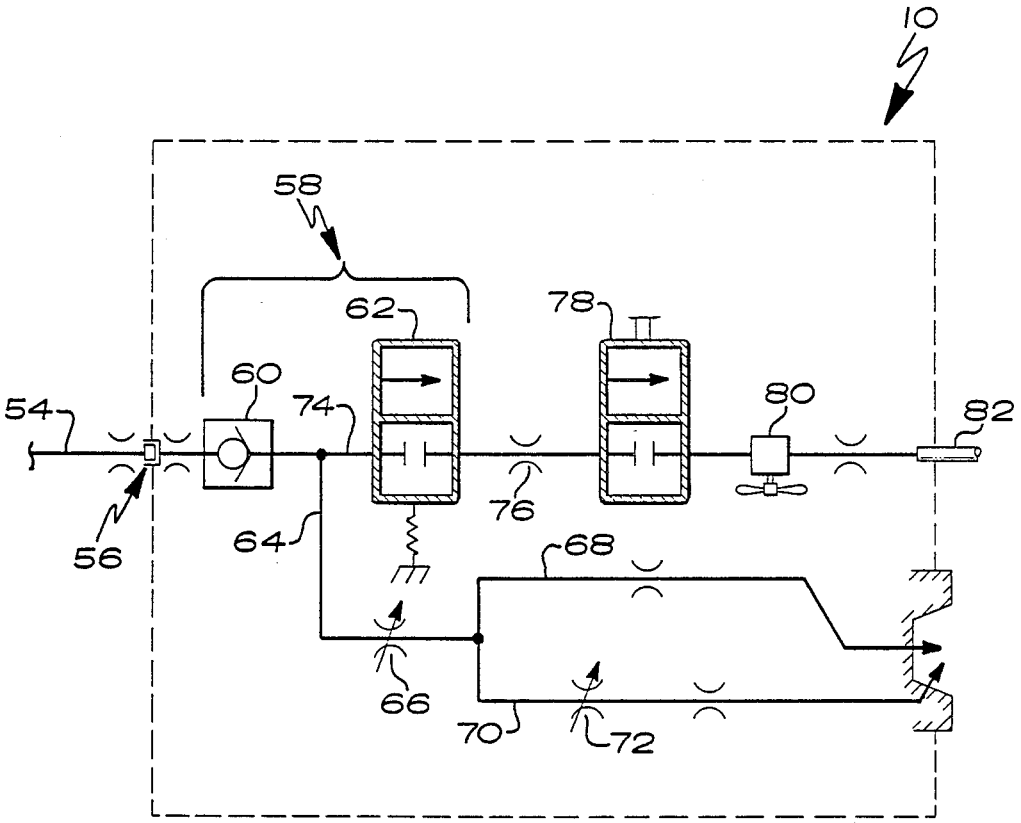
FIG. 4 is a schematic view of the air circuitry in the gun of the instant invention.

The schematic of the air circuitry of the gun is shown in FIG. 4. There, a hose 54 is attached to a gun inlet 56.

Thereafter, the air goes to trigger valve 58 which is comprised of a main air valve 60 and turbine air valve 62. Trigger valve 58 is arranged so that when the gun 10 is untriggered, air cap passage 64 is sealed from turbine passage 74. This prevents any fluids which enter the air cap passages from reaching the turbine or electronics. If desired, the turbine air supply can be constantly provided with pressurized air to further isolate the power supply.

The air cap air supply 64 leads out of main air valve 60 to an air cap air control 66. Thereafter, the air is split into an atomizing air passage 68 and a fan air passage 70. The air in fan air passage 70 may be controlled by a fan pattern control 72. Similarly, the turbine air supply 74 passes through a flow washer regulator 76 and thence to an electrostatic on-off air valve 78 feeds turbine 80. Thereafter, the air 80 is blown over the electronics in power supply cartridge 12 and thence through exhaust tube 82.

It is contemplated that various changes and modifications may be made to the electrostatic spray gun without departing from the spirit and scope of the invention as defined by the following claims.

What is claimed is:

1. The electrostatic spray gun comprising an air-powered self-contained power supply comprising an air-powered turbine, an alternator and electronic components which include electrical contact points, a voltage regulator and a voltage multiplier, the improvement comprising at least one of said electronic components comprising a fluid impervious heat sink member and said electronic components being completely potted in solvent resistant material with only said fluid impervious heat sink and electrical contact points extending through said solvent resistant potting material.

2. The electrostatic spray gun of claim 1 further comprising a visual indicator of voltage extending through said solvent resistant potting material.

3. The electrostatic spray gun of claim 1 wherein said heat sink is metallic.

* * * * *

UNITED STATES PATENT AND TRADEMARK OFFICE

CERTIFICATE OF CORRECTION

PATENT NO. : 4,978,075

DATED : December 18, 1990

INVENTOR(S) : Lind et al

It is certified that error appears in the above-identified patent and that said Letters Patent is hereby corrected as shown below:

On the title page item [75] Inventors: should read as follows:
-- Robert J. Lind, Robbinsdale, MN; Stanley G. Karwoski, Oakdale, MN; -- Lawrence J. Lunzer, St. Louis Park, MN --

Signed and Sealed this

Fourteenth Day of July, 1992

*Attest:*

DOUGLAS B. COMER

*Attesting Officer*

*Acting Commissioner of Patents and Trademarks*